US006991233B2

(12) United States Patent
Goldsmith, Jr.

(10) Patent No.: US 6,991,233 B2
(45) Date of Patent: Jan. 31, 2006

(54) AUTOMATIC RESETTING SHOOTING GALLERY

(76) Inventor: Donald Edward Goldsmith, Jr., 8402 Heatherwick Dr., Brandywine, MD (US) 20613

( * ) Notice: Subject to any disclaimer, the term of this patent is extended or adjusted under 35 U.S.C. 154(b) by 0 days.

(21) Appl. No.: 10/407,661

(22) Filed: Apr. 7, 2003

(65) Prior Publication Data

US 2004/0195775 A1 Oct. 7, 2004

(51) Int. Cl.
*F41J 7/04* (2006.01)

(52) U.S. Cl. ..... 273/392

(58) Field of Classification Search ..... 273/390–392, 273/406, 407, 388
See application file for complete search history.

(56) References Cited

U.S. PATENT DOCUMENTS

| | | | | |
|---|---|---|---|---|
| 3,411,784 | A * | 11/1968 | Lawrence | 273/388 |
| 3,844,559 | A * | 10/1974 | Davidson et al. | 273/383 |
| 5,263,722 | A * | 11/1993 | Rosellen | 273/391 |
| 6,347,798 | B1 * | 2/2002 | Quiring et al. | 273/391 |
| 6,502,820 | B2 * | 1/2003 | Slifko | 273/391 |

FOREIGN PATENT DOCUMENTS

DE 3534746 * 4/1987

* cited by examiner

*Primary Examiner*—Mark S. Graham

(57) ABSTRACT

An automatic resetting target apparatus consisting of multiple knockdown targets and a reset target on the same vertical and horizontal plane. The knockdown targets, when hit by a bullet or other projectile, will fall backward and down. The knockdown targets will remain down until the reset target is hit by a bullet or other projectile. All targets will then return to their original upright position allowing for continuous shooting.

4 Claims, 4 Drawing Sheets

AUTOMATIC RESETTING SHOOTING GALLERY

BACKGROUND OF THE INVENTION

This invention relates to automatic resetting targets arranged in an upright position with all targets on the same vertical and horizontal plane. The targets drop when hit by a bullet or projectile and remain down until the reset target is also hit by a bullet or projectile. This would allow for constant shooting by the Shooter, and therefore would be challenging. Challenging the shooter's ability is one of the joys of target shooting. Targets that reset rapidly without swinging would result in faster shooting since the Shooter does not have to wait for the target to stop swinging. It is also desirable to be able to shoot safely at the target from different shooting positions, for example, Prone, Benchrest, and Kneeling. Targets that could be placed on a bench or close to the ground would make shooting from different positions easier. Simplicity in its operation and ease of manufacture would be very desirable. The shooting gallery should be stable enough to keep it from moving about when hit by a bullet or projectile and light enough for ease of carry. The operating mechanism must be protected from a damaging hit from a bullet or projectile.

SUMMARY OF THE INVENTION

The invention is a shooting gallery made up of numerous targets that are in an up right vertical position, spaced evenly on the same vertical and horizontal plane. All the targets pivot on a horizontal shaft that extends the length of the shooting gallery. Compression springs and spacers along the shaft assist the extension springs in holding the targets up right in a vertical position. The extension spring is attached at one end to the bottom of the target leg and the other end is attached to a rod that is mounted on the back support frame. The said extension spring holds the back portion of the target leg firmly against the front edge of the back support frame. When the target is hit by a bullet or projectile, with ample force, the target will pivot back and down stretching and loading the extension springs enough to lift the target when released. A latch made into the bottom of the target leg will come into contact with the catch bar preventing the target from returning to its original position. The catch bar running the length of the shooting gallery, and attached at both ends, is allowed to pivot freely. All the targets operate the same way except the reset target which does not have a latch. The catch bar is held into position just far enough to allow the target latch to pass by and come into contact with the catch bar. The catch bar is held into above said position with an adjustable stop. When the reset target is hit by a bullet or projectile it will pivot back and down in the same manner as the other targets. The bottom portion of the reset target is radiused so that when the target is almost all the way down the radiused end will come in contact with and move the catch bar to release the targets. The reset target returns to its original position and the sequence starts over. Compression springs and spacers between the targets maintain the targets in an up right position and compensate for wear.

DETAILED DESCRIPTION OF THE INVENTION

Figure 1:
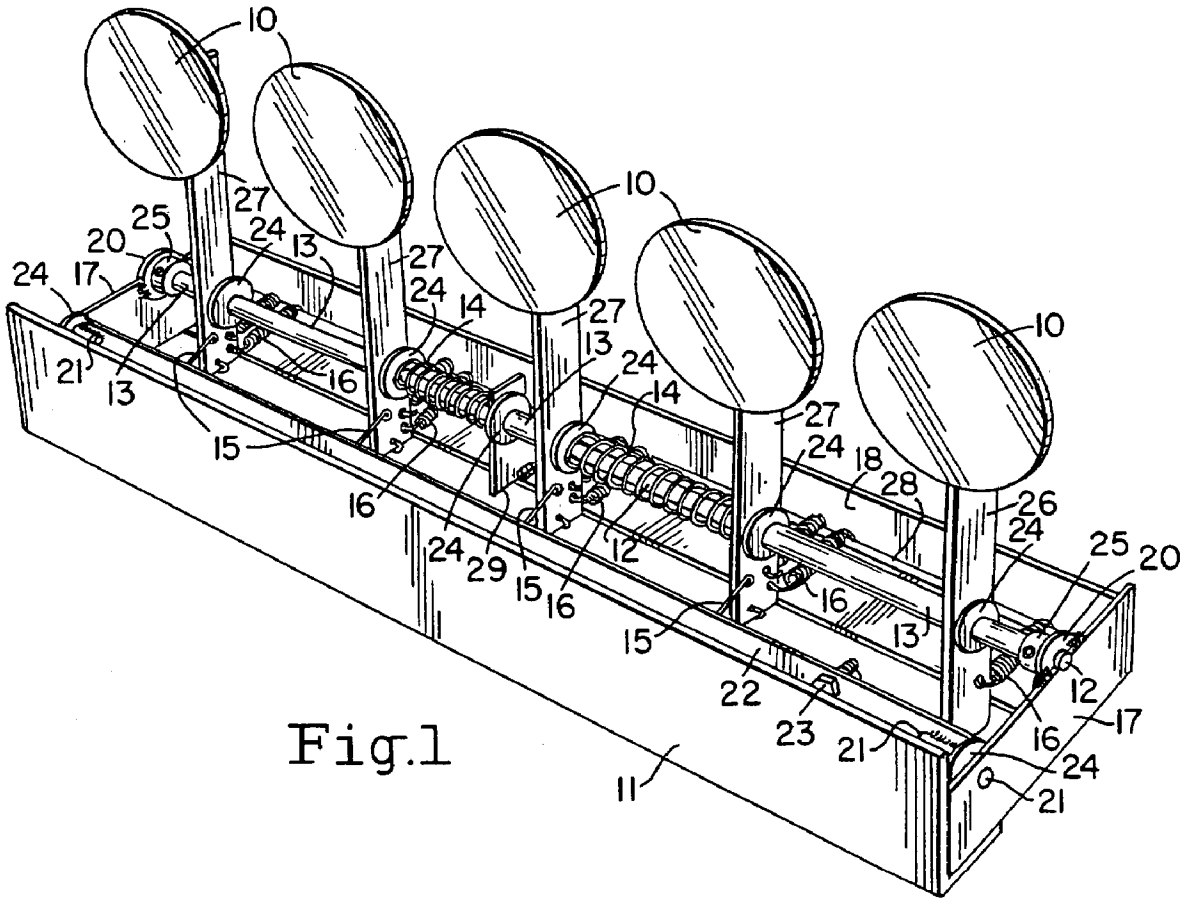
FIG. 1 is a top perspective view of the Automatic Resetting Shooting Gallery

FIG. 1 shows the Automatic Resetting Shooting Gallery with multiple targets numbered 10. All targets are in the vertical upright position before being hit by a bullet or projectile. All the targets are arranged along the same vertical and horizontal plane. The individual targets are made preferably of metal or other material capable of resisting the continued impact of a bullet or other projectile. The support frame consists of a front angle support 11 which extends upward to protect the target support shaft 12, spacers 13, compression springs 14, target latch 15, extension springs 16, and the catch mechanism consisting of catch angle bar 22, support shaft 21, stop 23, washers 24, and locking collars 25. The other side or surface of front angle support 11 forms the base for the Automatic Resetting Shooting Gallery to sit; said surface of front angle support 11 also forms a support base for side support angles 17.

Side support angles 17 are attached to front angle support 11 by welding or other means of secure attachment. Side support angles 17 are so positioned as to form the outside surface of the support frame and also forms a base to sit the rear support angle 18. Rear support angle 18 is so positioned so that one surface forms the outside edge of the frame with the other surface inside the frame and rests on the side support angle 17. Front support angle 11, side support angles 17, and rear support angle 18 are welded together or firmly attached by other means to form the rectangular support frame and base of the Automatic Resetting Shooting Gallery.

Figure 2:
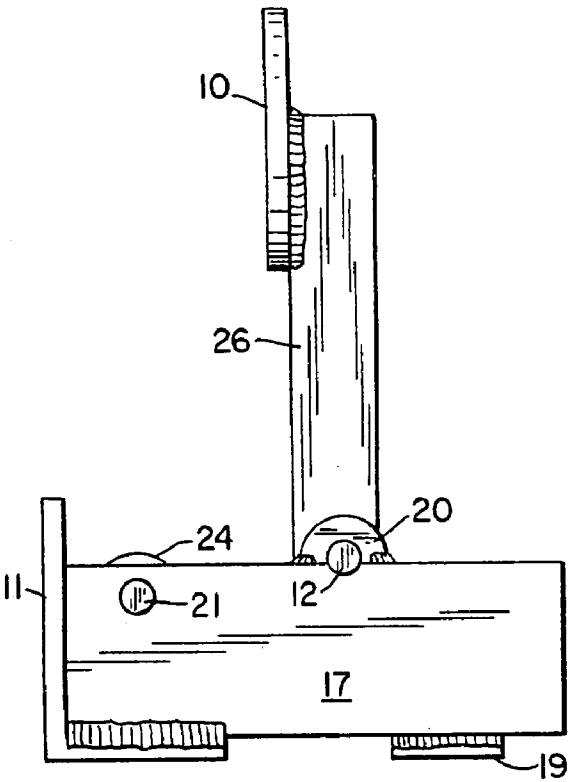
FIG. 2 is an end view thereof.

FIG. 2 of the Automatic Resetting Shooting gallery is an end view showing front angle 11, and side support angle 17. Side support angle 17 has a spacer 19 made of metal, wood, or other material attached by welding or other means to firmly attach the spacer 19. Spacer 19 will make up the difference of front angle support 11 to hold the Automatic Resetting Shooting Gallery level. Front support angle 11 is positioned so that one surface extends vertically upward to form the front surface of the shooting gallery, the other surface of said front support angle 11 is positioned inward and flat to form the base of the Automatic Resetting Shooting Gallery. The side support angle 17 is placed on the flat base surface of front angle 11 so that one surface of said side support angle 17 is in a vertical upright position to form the outside surface of the support frame, the other surface of said side support angle 17 is placed inward and rests flat on the base of front support angle 11. Side support angle 17 is notched slightly to seat shaft 12, a washer 20 is attached to said side support angle 17 to accept and hold said shaft 12. Shaft 12 extends the length of the Automatic Resetting Shooting Gallery and is held in place on end support angle 17 by lock collars 25 or other suitable means.

Side support angle 17 has a hole drilled through on the outside vertical surface towards the front of the Automatic Resetting Shooting Gallery, the said hole is slightly larger than shaft 21 to allow rotation. Individual targets 10 are attached to the top portion of target legs 27 and target leg 26 by welding or other secure means of attachment, and said target legs 26 and 27 have a hole drilled through to allow mounting on shaft 12 so that said target legs 26 and 27 can pivot freely.

Figure 3:
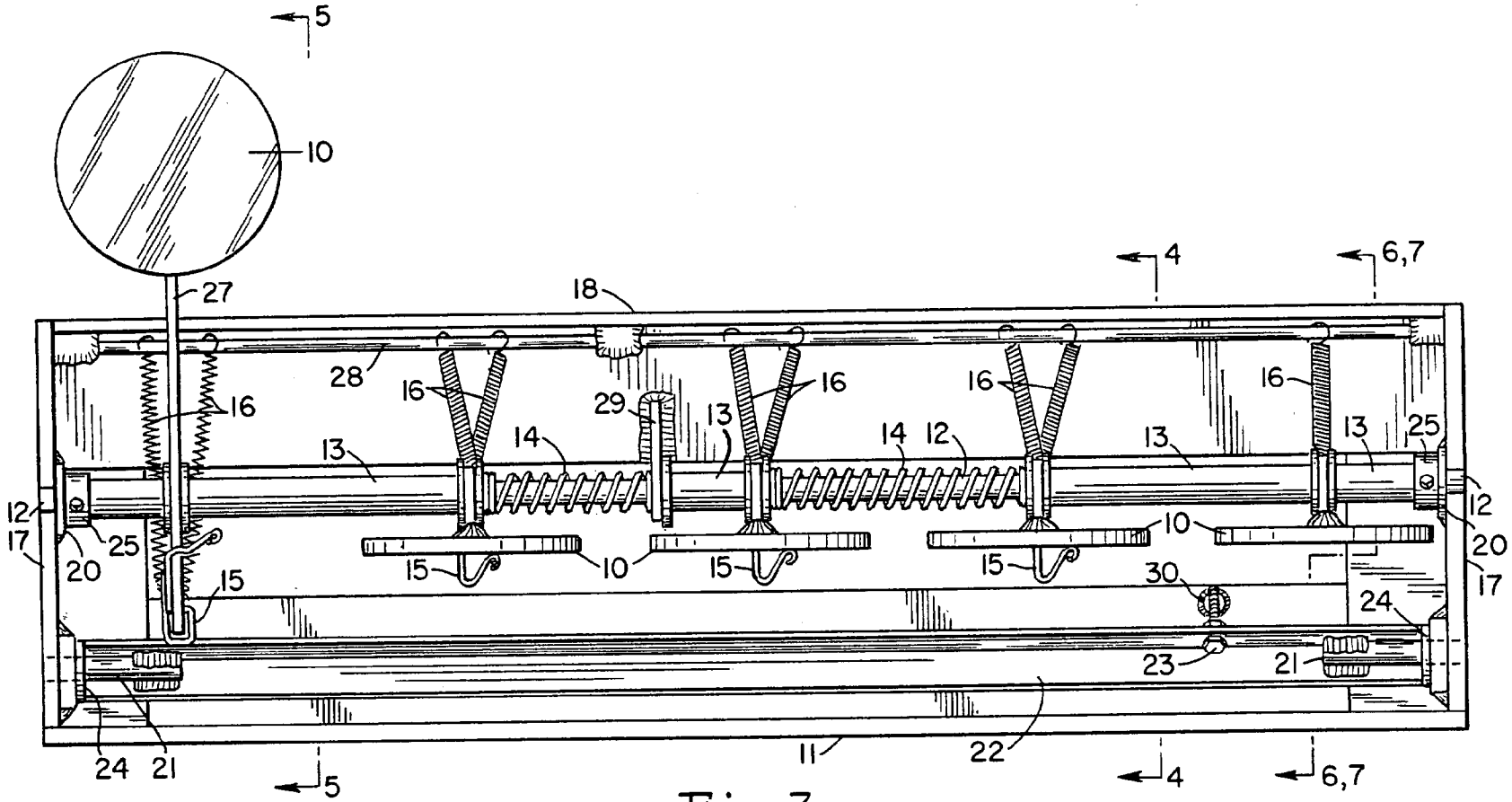
FIG. 3 is a top plan view thereof showing one target lying down after being hit by a bullet or projectile.

FIG. 3 is a top plain view showing one target after being hit by a bullet or projectile. Targets 10 when hit by a bullet or projectile of sufficient force will cause said target 10 to fall back and down, whereas target legs 26 and 27 pivot upon shaft 12 stretching and loading extension springs 16. Latch 15 is in contact with catch bar 22, and said catch bar 22 is held in position by adjustable stop 23 and adjustable stop 30. Extension springs 16 are attached at one end to a rod 28 that extends the inside length of the rear support angle 18. Rod 28 is secured to rear support angle 18 by welding or any other means to firmly attach and allow springs 16 to be connected. Center shaft support 29 has a hole drilled through it to allow shaft 12 to pass through. Center shaft support 29 is attached to rear support angle 18. Latch 15 is made from one piece of wire that is inserted through a hole drilled in target legs 27 and bent to allow said latch 15 to pivot freely. One end of the wire is carried back towards the top of the said target leg 27 and wrapped over the front edge to form the latch stop when the bottom of said latch 15 is in contact with catch bar 22. The other end of the wire is bent down toward the bottom of said target leg 27, bent perpendicular across the bottom edge and close enough to the bottom edge of said target leg 27 to form a stop for latch 15 when not in contact with said catch bar 22.

Spacers 13 of round tubing are placed over shaft 12 and between target legs 27 and target leg 26 to provide even spacing of targets 10. Washers 24 are placed on each side of target legs 27 and target leg 26. Spacers 13 are cut to length to allow even spacing of target 10. Compression springs 14 are placed over shaft 12 and on each side of the center target 10 so as to force target legs 27, target leg 26, spacers 13, and washers 24 towards the locking collars 25. Therefore, said target legs 27 and target leg 26 are held in a perpendicular position.

Figure 4:
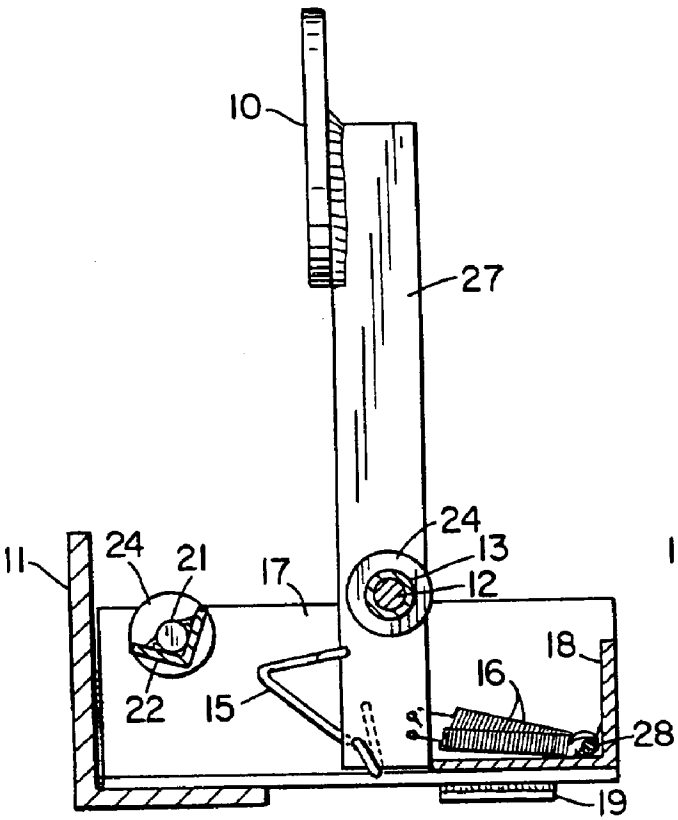
FIG. 4 is a cross-section taken along line 4—4 of figure three showing one upright target.

FIG. 4 is a cross-section taken along line 4—4 of FIG. 3 showing one upright target. Target leg 27 is supported on shaft 12 and is allowed to pivot backwards. Extension springs 16 attached to the bottom and back portion of target leg 27 at one end, and attached to rod 28 at the other end, holds said target leg 27 against rear support angle 18. Latch 15 is in a relaxed position. Catch bar 22 is in the reset position.

Figure 5:
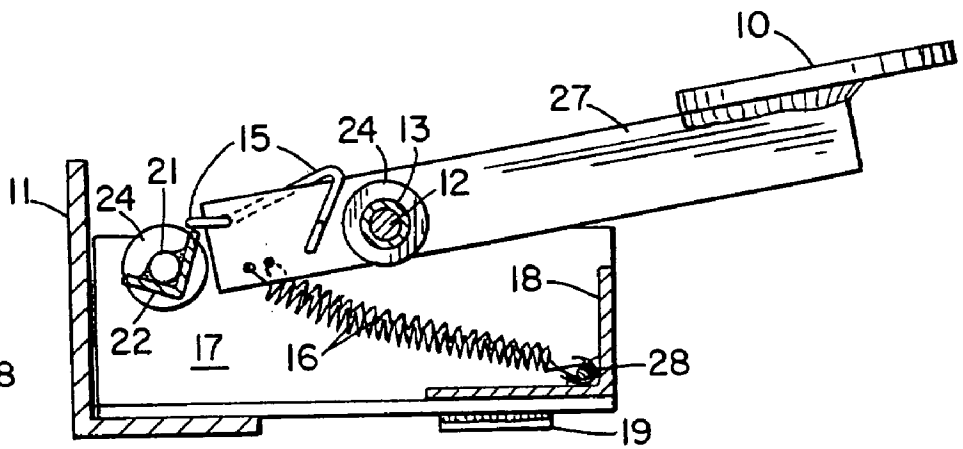
FIG. 5 is a cross-section taken along lines 5—5 of figure three showing one target being held down after being hit.

FIG. 5 is a cross-section taken along lines 5—5 of FIG. 3 showing one target being held down after being hit by a bullet or other projectile. Target 10 after being hit by a bullet or other projectile forces target leg 27 to pivot backward onto shaft 12 until said target leg 27 contacts the edge of rear support angle 18. At the same time, extension springs 16 are stretched and loaded to pull target leg 27 back down. Latch 15 is now in a position to contact catch bar 22, therefore preventing the target leg 27 from returning to the upright position. The top portion of latch 15 is now in contact with the front edge of target leg 27 preventing it from rotating.

Figure 6:
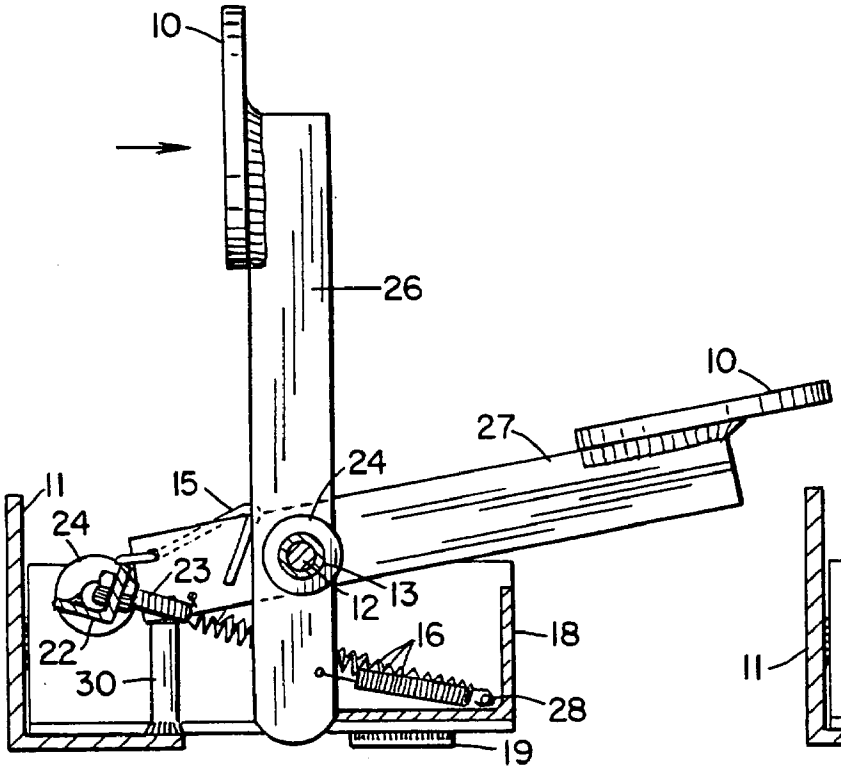
FIG. 6 is a cross-section taken along lines 6—6 of figure three showing the farthest right target about to be hit while the other targets are held down after being hit.

FIG. 6 is a cross-section taken along lines 6—6 of FIG. 3 showing the farthest right target about to be hit while the other targets are held down after being hit. Catch bar 22 is held in its normal position by adjustable stop 23 and adjustable stop 30. Adjustable stop 23 is attached to catch bar 22 so as to weigh one edge of said catch bar 22 to hold said catch bar 22 and adjustable stop 23 against adjustable stop 30. Target 10 and reset target leg 26 are in their normal upright position held against rear support angle 17 by extension spring 16.

Figure 7:
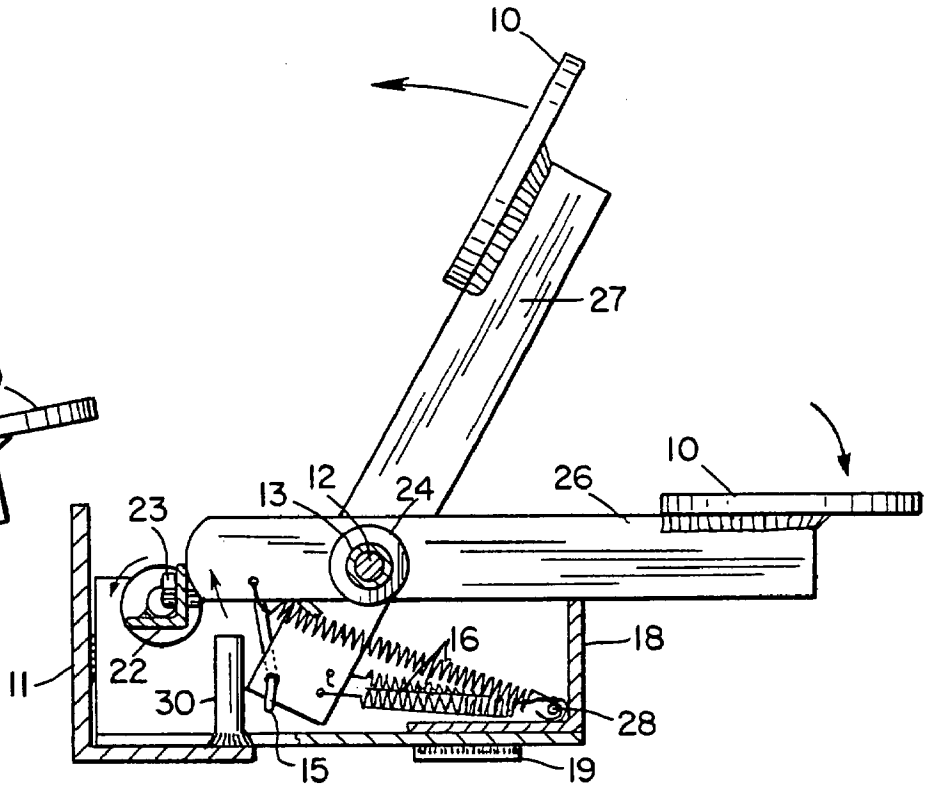
FIG. 7 is a view similar to figure six but with the end target falling while releasing all of the targets to spring up to the reset position.

FIG. 7 is a view similar to FIG. 6 but with the end target falling while releasing all of the targets to spring up to the normal upright position. Target 10, attached to reset target leg 26, is forced back and down by a bullet or other projectile until said reset target leg 26 contacts rear support angle 17. The radiused end of reset target leg 26 contacts catch bar 22 causing said catch bar 22 to pivot away from adjustable stop 30 releasing all targets. Reset target leg 26 is pulled back down by extension spring 16 until it stops against rear support angle 17. Catch bar 22 and adjustable stop 23 simultaneously pivots back to the normal position against adjustable stop 30. The process is ready to repeat.

What is claimed is:

1. A multiple target self-resetting shooting apparatus comprising:

(a) a rectangular frame to not only support the targets as a base but also to provide the back stop for the targets and a front plate to protect the mechanism from missed bullets or other projectiles;

(b) multiples of individually operated targets positioned on a common horizontal shaft on the same vertical and horizontal plane by target legs, the targets when struck by a bullet or other projectile will pivot backward and down and will remain down until a reset target is struck by a bullet or other projectile;

(c) compression springs and spacers positioned along the horizontal shaft between the targets will hold them in an upright position and compensate for wear;

(d) a horizontal back stop common to all targets will hold them in an upright position with the use of extension springs, individual targets each held in an upright vertical position on a common horizontal shaft by the use of said extension springs, the extension springs will immediately attempt to return the target to its original upright position, but is prevented from returning to its original position by a target latch which comes into contact with a horizontal catch bar;

(e) said extension springs have one end attached to the back support frame to hold the target in an upright position and serve to return the target, after it is hit by a bullet or other projectile, to its original upright position;

(f) said horizontal catch bar is common to all targets and will hold them in the down position, the catch bar is made to pivot freely and is held into position by an adjustable stop and gravity; a reset target when hit by a bullet or other projectile pivots backward and down further loading the extension springs; a bottom portion of the reset target contacts the catch bar rotating the catch bar out of position just enough to free the target latches, the reset target returns to its original vertical upright position by extension springs, the catch bar simultaneously falls back into its original position by gravity;

(g) said latch made from one piece of wire so formed and bent onto the individual target legs so as to pass by the catch bar when the target is struck by a bullet or other projectile, the latch once past the catch bar will fall into a position as to come into contact with the catch bar when the extension springs attempt to return the target to its original upright position.

2. The target apparatus of claim 1 wherein the rectangular frame is made up of a front support which is made to extend to a height sufficient enough to protect internal mechanisms;

attached to the front support are the two end supports that support the ends of the catch bar and target horizontal shaft; positioned horizontally to the front support is a rear support that is attached to an end support in such a manner as to provide a stop for the back of all the target legs and also serve as a back stop for the targets when they are hit by a bullet or other projectile thereby causing a rebound effect that will throw the latch into position to contact the catch bar upon return, the rebound effect and the associated load applied by the extension spring will hold the latch against the catch bar.

3. The target apparatus of claim 1 wherein the target horizontal shaft is attached to the rectangular frame end supports at a location that will allow the targets to stand upright in a vertical position and also allow the target to fall back and down enough to allow the catch on the knockdown targets to pass by the catch bar; to prevent the horizontal shaft from flexing under load a center support is provided and attached to a rear support; washers on each side of the target legs work in conjunction with the spacers and compression springs to evenly space the targets along the target shaft as well as provide a vertical support for the target legs and allow for some give along the shaft to keep the target legs from bending form the impact of a heavy projectile.

4. The target apparatus of claim 1 wherein the catch bar is positioned horizontally in front of the target pivot shaft and pivots freely in the frame and supports, the catch bar is weighed on the side toward the targets by an adjustable stop that is held against another adjustable stop by gravity; the position of the catch bar is adjustable by the adjustable stop that is attached to a front frame support, the catch bar will remain against the adjustable stop until moved by the contact of a reset target leg, once the reset target leg moves out of contact with the catch bar the catch bar will drop back down against the adjustable stops by the effluence of gravity, the reset target leg is slightly longer than the target legs that incorporate the latch so that when the reset target is hit by a projectile it will move back and down while simultaneously loading an extension spring, the end of the target leg will contact the edge of the catch bar just enough to free the latches that are in contact against the catch bar; the reset target will simultaneously contact the catch bar and the back stop, the rebound effect of the reset target contacting the back stop and the extended extension spring will cause the reset target to immediately return to its original upright vertical position.

* * * * *